US011873684B2

(12) United States Patent
Zhao et al.

(10) Patent No.: US 11,873,684 B2
(45) Date of Patent: Jan. 16, 2024

(54) POLYCRYSTALLINE DIAMOND COMPACT

(71) Applicant: SF Diamond Co., Ltd., Zhengzhou (CN)

(72) Inventors: Dongpeng Zhao, Zhengzhou (CN); Weifeng Du, Zhengzhou (CN); Tongjian Niu, Zhengzhou (CN); Tengfei Wen, Zhengzhou (CN); Chunlin Zhang, Zhengzhou (CN); Haijiang Fang, Zhengzhou (CN)

(73) Assignee: SF DIAMOND CO., LTD., Zhengzhou (CN)

( * ) Notice: Subject to any disclaimer, the term of this patent is extended or adjusted under 35 U.S.C. 154(b) by 32 days.

(21) Appl. No.: 17/170,869

(22) Filed: Feb. 8, 2021

(65) Prior Publication Data

US 2021/0164296 A1 Jun. 3, 2021

Related U.S. Application Data

(63) Continuation-in-part of application No. 16/297,718, filed on Mar. 11, 2019, now abandoned, which is a continuation-in-part of application No. PCT/CN2017/105474, filed on Oct. 10, 2017.

(30) Foreign Application Priority Data

Mar. 14, 2017 (CN) ..... 201710149094.2

(51) Int. Cl.
*E21B 10/567* (2006.01)

(52) U.S. Cl.
CPC ..... *E21B 10/5673* (2013.01); *E21B 10/5676* (2013.01)

(58) Field of Classification Search
CPC ..... E21B 10/5671; E21B 10/5673; E21B 10/5676
See application file for complete search history.

(56) References Cited

U.S. PATENT DOCUMENTS 6,065,554 A * 5/2000 Taylor ..... E21B 10/5735 175/430
7,726,420 B2 * 6/2010 Shen ..... E21B 10/5735 175/430

(Continued)

*Primary Examiner* — Blake Michener
(74) *Attorney, Agent, or Firm* — MATTHIAS SCHOLL P.C.; Matthias Scholl

(57) ABSTRACT

A polycrystalline diamond compact including a polycrystalline diamond layer and a cemented carbide substrate. The polycrystalline diamond layer is in the form of a cylinder including an upper surface, a bottom surface, and a side wall connecting the upper surface and the bottom surface. The cemented carbide substrate is bonded to the bottom surface of the polycrystalline diamond layer. The upper surface includes a center part and an edge part. The edge part includes a plurality of radially distributed cutting edges and cutting removal grooves. The plurality of cutting edges and cutting removal grooves are alternately distributed on the upper surface. One end of each of the plurality of cutting edges and cutting removal grooves extends to communicate with the center part, and the other end of each of the plurality of cutting edges and cutting removal grooves extends to communicate with the side wall.

16 Claims, 14 Drawing Sheets

(56) References Cited

U.S. PATENT DOCUMENTS

| | | | | |
|---|---|---|---|---|
| 7,762,359 | B1 * | 7/2010 | Miess | E21B 10/633 175/426 |
| 9,376,867 | B2 * | 6/2016 | DiGiovanni | B24C 1/04 |
| 10,022,840 | B1 * | 7/2018 | Miess | E21B 10/567 |
| 10,125,552 | B2 * | 11/2018 | Zhao | E21B 10/5673 |
| 10,240,399 | B2 * | 3/2019 | Rahmani | E21B 10/5676 |
| 10,280,688 | B2 * | 5/2019 | Dunbar | E21B 10/5676 |
| 10,563,464 | B2 * | 2/2020 | Davila | E21B 10/5673 |
| 10,577,870 | B2 * | 3/2020 | Izbinski | E21B 10/567 |
| 2010/0084198 | A1 * | 4/2010 | Durairajan | E21B 10/55 175/425 |
| 2014/0182947 | A1 * | 7/2014 | Bhatia | E21B 10/46 175/327 |
| 2015/0259988 | A1 * | 9/2015 | Chen | E21B 10/5673 175/430 |
| 2016/0230471 | A1 * | 8/2016 | Gonzalez | F16C 33/26 |
| 2018/0318962 | A1 * | 11/2018 | Zhao | B23K 26/0624 |
| 2018/0334860 | A1 * | 11/2018 | Azar | E21B 10/42 |
| 2019/0106943 | A1 * | 4/2019 | Tilleman | E21B 10/43 |
| 2019/0203539 | A1 * | 7/2019 | Zhao | E21B 10/5673 |
| 2019/0368276 | A1 * | 12/2019 | Zhao | E21B 10/5673 |
| 2019/0368277 | A1 * | 12/2019 | Zhao | C04B 35/528 |
| 2019/0376346 | A1 * | 12/2019 | Vijayabalan | E21B 10/46 |
| 2020/0032589 | A1 * | 1/2020 | Izbinski | E21B 10/5673 |
| 2020/0224500 | A1 * | 7/2020 | Dubose | E21B 10/5676 |

* cited by examiner

POLYCRYSTALLINE DIAMOND COMPACT

CROSS-REFERENCE TO RELATED APPLICATIONS

This application is a continuation-in-part of U.S. application Ser. No. 16/297,718, filed Mar. 11, 2019, which is a continuation-in-part of International Patent Application No. PCT/CN2017/105474 with an international filing date of Oct. 10, 2017, designating the United States, and further claims foreign priority benefits to Chinese Patent Application No. 201710149094.2 filed Mar. 14, 2017. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

This disclosure relates to the field of composite materials, and more particularly, to a polycrystalline diamond compact (PDC).

Polycrystalline diamond compacts (PDCs) are made by combining layers of polycrystalline diamonds (PCDs) with a layer of cemented carbide substrate. PDCs have the advantages of diamond's wear resistance and carbide's toughness and are widely used in drill bits. However, conventional PDC drill bits are inefficient in breaking rocks or cutting removal.

SUMMARY

Disclosed is a polycrystalline diamond compact that is efficient in breaking formations as well as cutting removal.

Disclosed is a polycrystalline diamond compact comprising a polycrystalline diamond layer and a cemented carbide substrate. The polycrystalline diamond layer is in the form of a cylinder comprising an upper surface, a bottom surface, and a side wall being the lateral surface of the cylinder and connecting the upper surface and the bottom surface. The cemented carbide substrate is bonded to the bottom surface of the polycrystalline diamond layer.

The upper surface comprises a center part and an edge part; the edge part comprises a plurality of cutting edges and a plurality of cutting removal grooves that are radially distributed on the upper surface; the plurality of cutting edges and the plurality of cutting removal grooves are alternately distributed on the upper surface; and a first end of each of the plurality of cutting edges and the plurality of cutting removal grooves extends to communicate with the center part, and a second end of each of the plurality of cutting edges and the plurality of cutting removal grooves extends to communicate with the side wall.

Each of the plurality of cutting edges can comprise a first side surface and a second side surface, and an included angle between the first side surface and the second side surface can be greater than or equal to 90°.

The plurality of cutting edges and the plurality of cutting removal grooves can extend radially and are annularly distributed on the upper surface.

The plurality of cutting edges and the plurality of cutting removal grooves can form an annular structure on the upper surface.

The included angle between each of the plurality of cutting edges and the side wall can be greater than or equal to 90°. The included angle between the each of the plurality of cutting edges and the side wall is an angle formed between a first straight line and a second straight line, where the first straight line is in the plane of symmetry of the each of the plurality of cutting edges and passes through the center point of the center part and the point where the second end of the each of the plurality of cutting edges intersects with the plane of symmetry of the each of the plurality of cutting edges, and the second straight line is parallel to the side wall and intersects with the first straight line.

The included angle between each of the plurality of cutting removal grooves and the side wall can be greater than or equal to 90°. The included angle between the each of the plurality of cutting removal grooves and the side wall is an angle formed between a third straight line and a fourth straight line, where the third straight line is in the plane of symmetry of the each of the plurality of cutting removal grooves and passes through the center point of the center part and the point where the second end of the each of the plurality of cutting removal grooves intersects with the plane of symmetry of the each of the plurality of cutting removal grooves, and the fourth straight line is parallel to the side wall and intersects with the third straight line.

The vertical distance from the peak of each of the plurality of cutting edges to the lowest point of the plurality of cutting edges can be greater than or equal to 0.3 mm, and the radial length of each of the plurality of cutting edges on the upper surface can be greater than or equal to 0.5 mm.

Chamfers can be disposed at a joint between the circumferential part of the upper part and the side wall.

The included angle between a cutting edge and an adjacent cutting removal groove is less than 60°, where the included angle between the cutting edge and the adjacent cutting removal groove is an angle formed between the first straight line and the third straight line.

The center part of the upper surface of the polycrystalline diamond layer can be provided with a cutting reservoir.

The cutting reservoir can be in the shape of circle or square.

The depth of the cutting reservoir relative to the upper surface can be less than one tenth of the thickness of the polycrystalline diamond layer from the upper surface to the bottom surface.

Advantages of the polycrystalline diamond compact in this disclosure are summarized as below. The polycrystalline diamond compact is efficient in breaking formations and cutting removal. In addition, the cutting element displays good impact resistance and excellent steerability.

DETAILED DESCRIPTION

To further illustrate, examples detailing a polycrystalline diamond compact are described below. It should be noted that the following examples are intended to describe and not to limit the description.

Example 1

Figure 1:
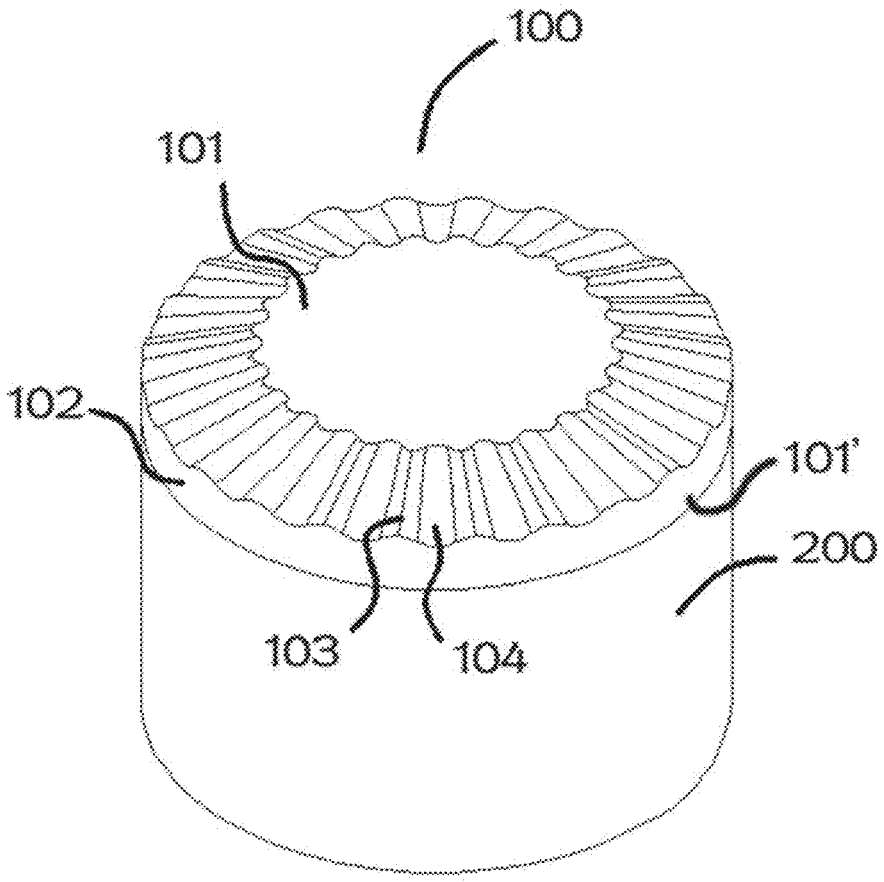
FIG. 1 is a schematic diagram of a polycrystalline diamond compact without a cutting reservoir of the disclosure.
Figure 2:
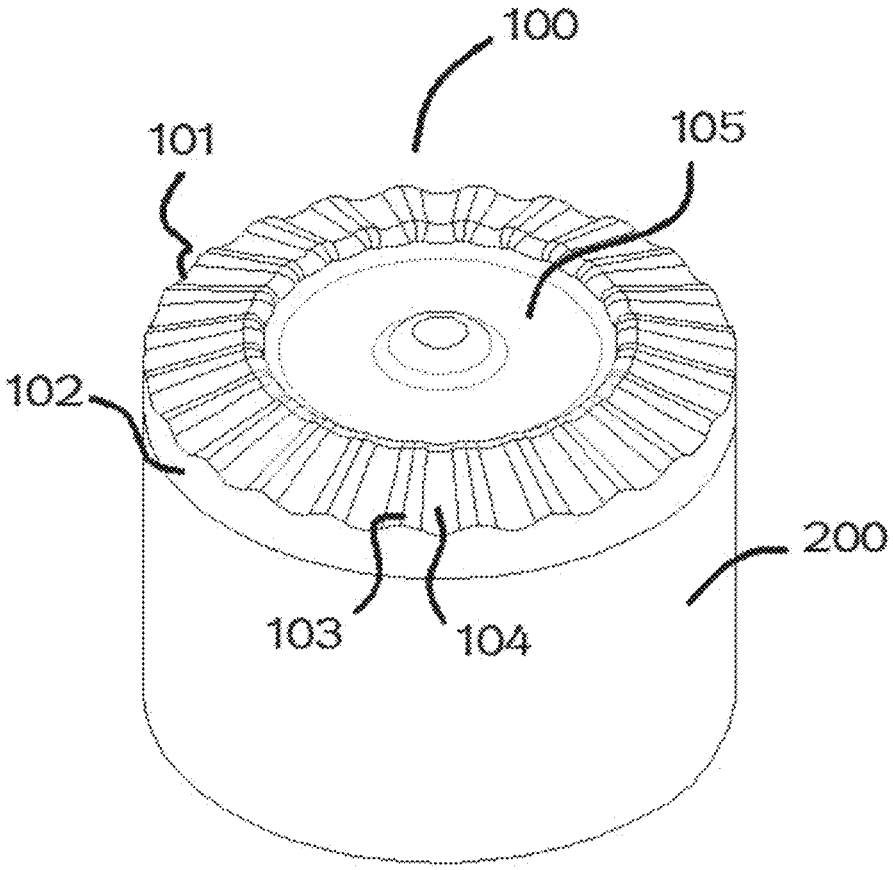
FIG. 2 is a schematic diagram of a polycrystalline diamond compact comprising a cutting reservoir of the disclosure.

As shown in FIGS. 1 and 2, a polycrystalline diamond compact of the disclosure comprises a polycrystalline diamond layer 100 and a cemented carbide substrate 200. The polycrystalline diamond layer 100 is in the form of a cylinder comprising an upper surface 101, a bottom surface 101', and a side wall 102 disposed between the upper surface 101 and the bottom surface 101'. The cemented carbide substrate 200 is bonded to the bottom surface 101' of the polycrystalline diamond layer 100.

The upper surface comprises a center part and an edge part. The edge part of the upper surface comprises a plurality of radially distributed cutting edges 103 and cutting removal grooves 104. The plurality of cutting edges and cutting removal grooves are alternately disposed. One end of each of the plurality of cutting edges and cutting removal grooves extends to communicate with the center part, and the other end of each of the plurality of cutting edges and cutting removal grooves extends to communicate with the side wall. Optionally, as shown in FIG. 2, the center part of the upper surface of the polycrystalline diamond layer is provided with a cutting reservoir 105. The cutting reservoir 105 comprises a central protrusion in a hemispherical shape.

Example 2

Figure 3:
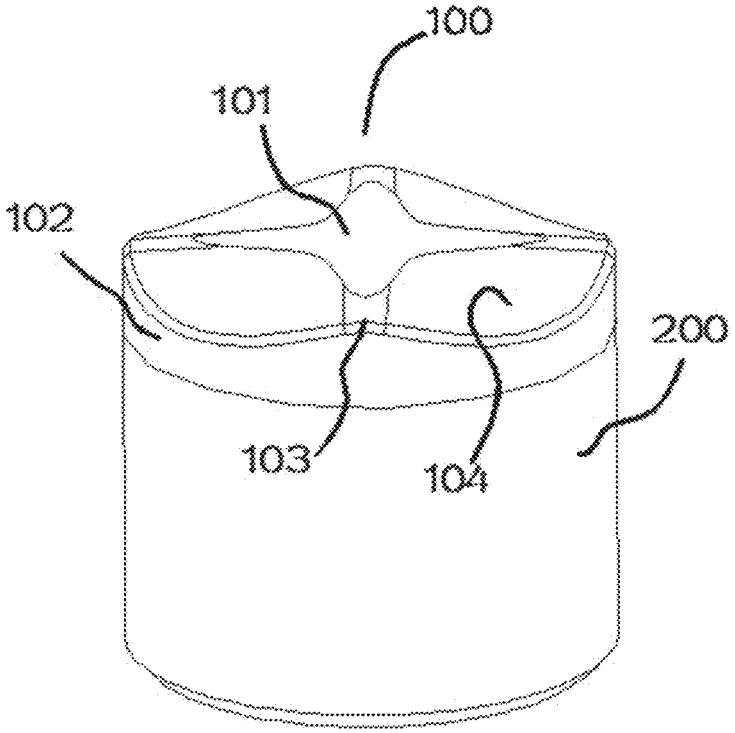
FIG. 3 is a schematic diagram of a polycrystalline diamond compact comprising four cutting edges of the disclosure.
Figure 4:
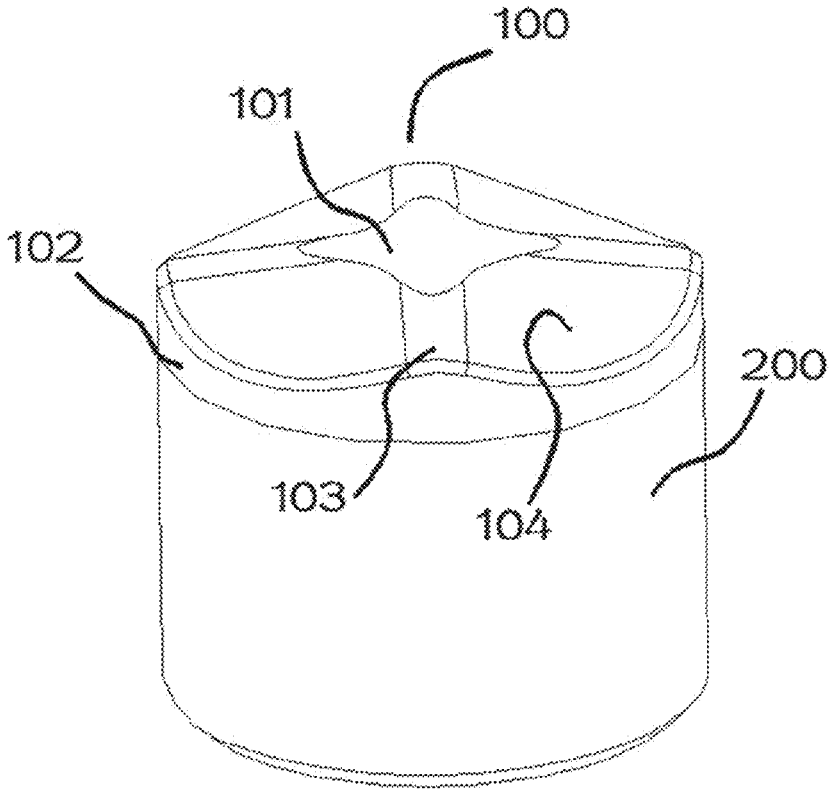
FIG. 4 is a schematic diagram of another polycrystalline diamond compact comprising four cutting edges of the disclosure.

As shown in FIGS. 3 and 4, a polycrystalline diamond compact comprising four cutting edges is provided. As shown in FIG. 3, the radial extension length of the cutting edges 103 of the polycrystalline diamond compact is 1.87 mm, and the vertical distance from the peak of each of the cutting edges to the lowest point of the cutting edges is 1.23 mm. The included angle between the cutting edges and the side wall 102 is 90°. The cutting removal grooves 104 and the cutting edges 103 are alternately disposed and form an annular structure on the upper surface with an included angle of 22° between the cutting removal grooves 104 and the cutting edges 103. The included angle between the cutting removal grooves 104 and the side wall 102 is 112°. The vertical height of the chamfer between the cutting edges 103, the cutting removal grooves 104 and the side wall 102 is 0.35 mm.

As shown in FIG. 4, the radial extension length of the cutting edges 103 of the polycrystalline diamond compact is 1.83 mm, and the vertical distance from the peak of each of the cutting edges to the lowest point of the cutting edges is 1.23 mm. The included angle between the cutting edges and the side wall 102 is 99.5°. The cutting removal grooves 104 and the cutting edges 103 are alternately disposed and form an annular structure on the upper surface with an included angle of 33.2° between the cutting removal grooves 104 and the cutting edges 103. The included angle between the cutting removal grooves 104 and the side wall 102 is 123.2°. The vertical height of the chamfer between the cutting edges 103, the cutting removal grooves 104 and the side wall 102 is 0.35 mm.

Example 3

Figure 5:
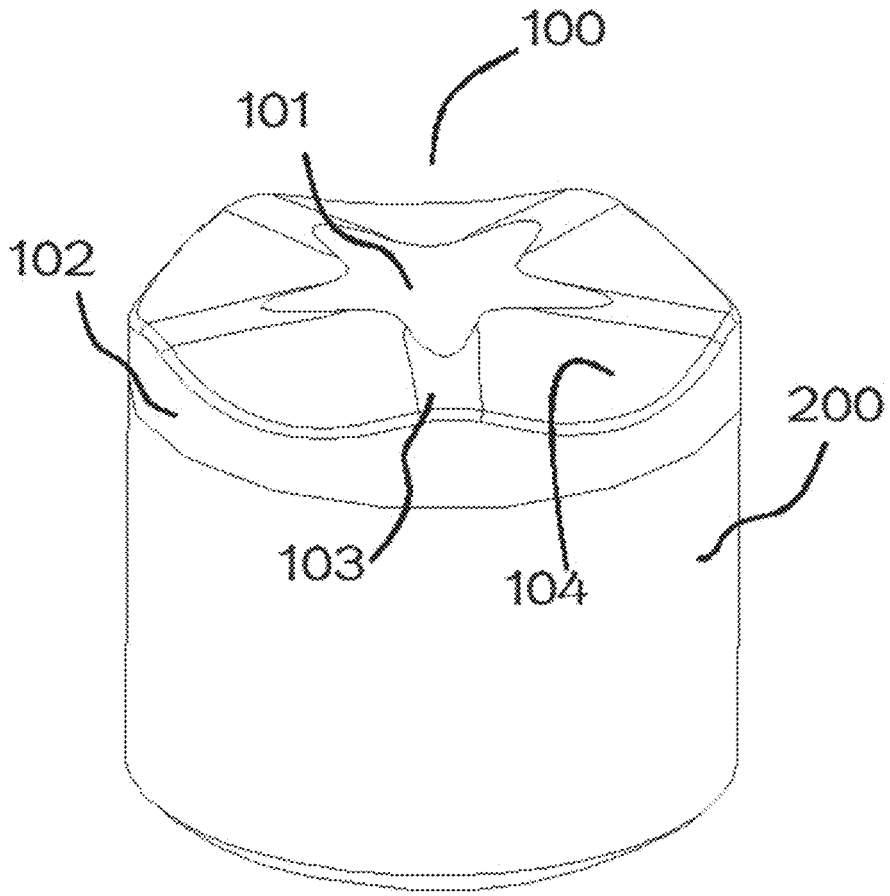
FIG. 5 is a schematic diagram of a polycrystalline diamond compact comprising five cutting edges of the disclosure.
Figure 6:
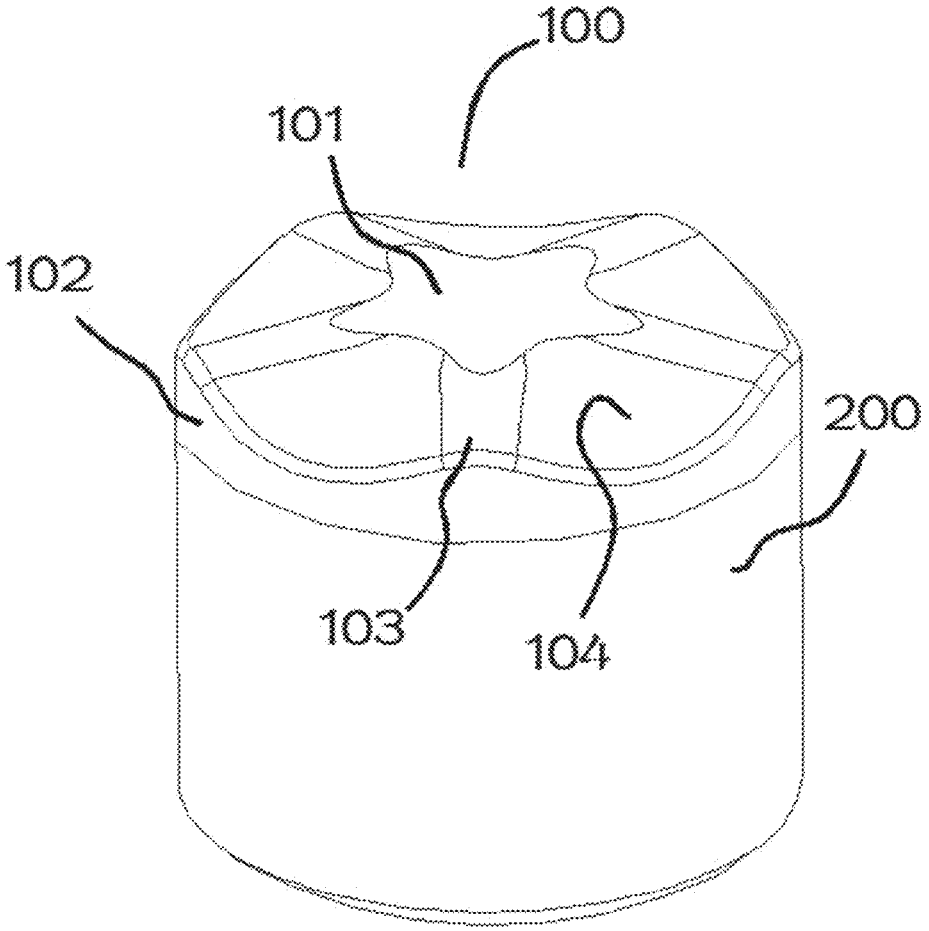
FIG. 6 is a schematic diagram of another polycrystalline diamond compact comprising five cutting edges of the disclosure.
Figure 13:
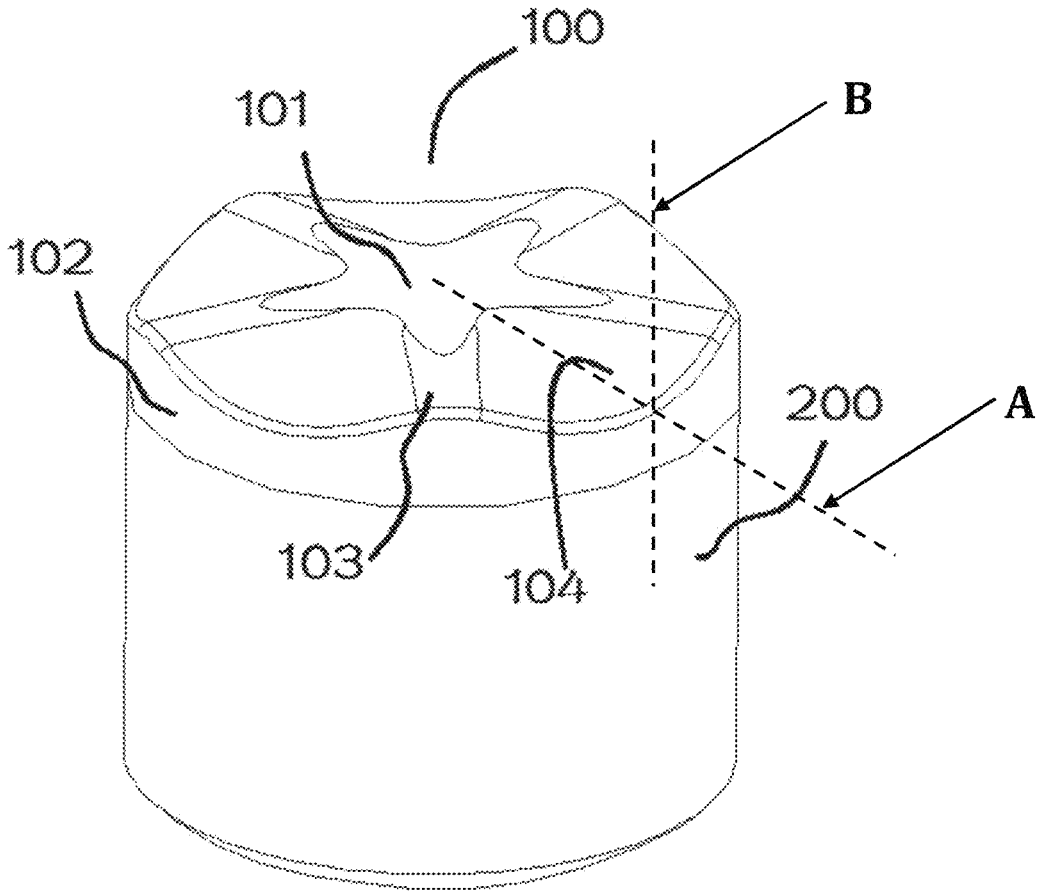
FIG. 13 is a schematic diagram of the polycrystalline diamond compact of FIG. 5 showing the included angle between one of the cutting removal grooves and the side wall.
Figure 14:
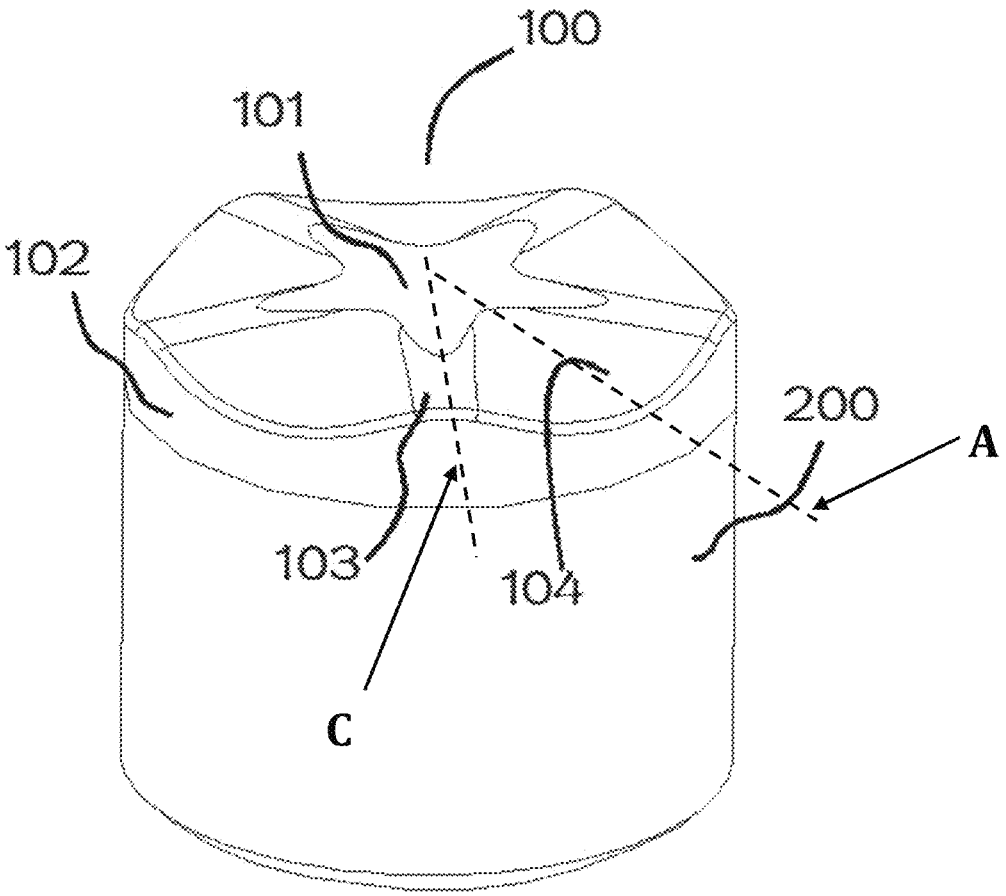
FIG. 14 is a schematic diagram of the polycrystalline diamond compact of FIG. 5 showing the included angle between one of the cutting edges and an adjacent cutting removal groove thereof.

As shown in FIGS. 5 and 6, a polycrystalline diamond compact comprising five cutting edges is provided. As shown in FIG. 5, the radial extension length of the cutting edges 103 of the polycrystalline diamond compact is 1.91 mm, and the vertical distance from the peak of each of the cutting edges to the lowest point of the cutting edges is 1.23 mm. The included angle between the cutting edges and the side wall 102 is 90°. The included angle between the cutting removal grooves 104 and the side wall 102 is 110°, where the included angle is formed between the dashed straight lines A and B as shown in FIG. 13. The dashed straight line A is in the plane of symmetry of the cutting removal groove 104 and passes through the center point of the center part 101 and the point where the second end of the cutting removal groove 104 intersects with the plane of symmetry of the cutting removal groove 104. The dashed straight line B is parallel to the side wall 102 and intersects with the dashed straight line A. The vertical height of the chamfer between the cutting edges 103, the cutting removal grooves 104 and the side wall 102 is 0.35 mm. As shown in FIG. 14, the cutting removal grooves 104 and the cutting edges 103 are alternately disposed and form an annular structure on the upper surface with an included angle of 20° between the cutting removal grooves 104 and the cutting edges 103, where the included angle between the cutting removal grooves 104 and the cutting edges 103 is formed between the dashed straight lines A and C, and the dashed straight line C is in the plane of symmetry of the cutting edge 103 and passes through the center point of the center part 101 and the point where the second end of the cutting edge 103 intersects with the plane of symmetry of the cutting edge 103.

As shown in FIG. 6, the radial extension length of the cutting edges 103 of the polycrystalline diamond compact is 1.87 mm, and the vertical distance from the peak of each of the cutting edges to the lowest point of the cutting edges is 1.23 mm. The included angle between the cutting edges and the side wall 102 is 100.1°. The cutting removal grooves 104 and the cutting edges 103 are alternately disposed and form an annular structure on the upper surface with an included angle of 35.6° between the cutting removal grooves 104 and the cutting edges 103. The included angle between the cutting removal grooves 104 and the side wall 102 is 125.6°. The vertical height of the chamfer between the cutting edges 103, the cutting removal grooves 104 and the side wall 102 is 0.35 mm.

Example 4

Figure 7:
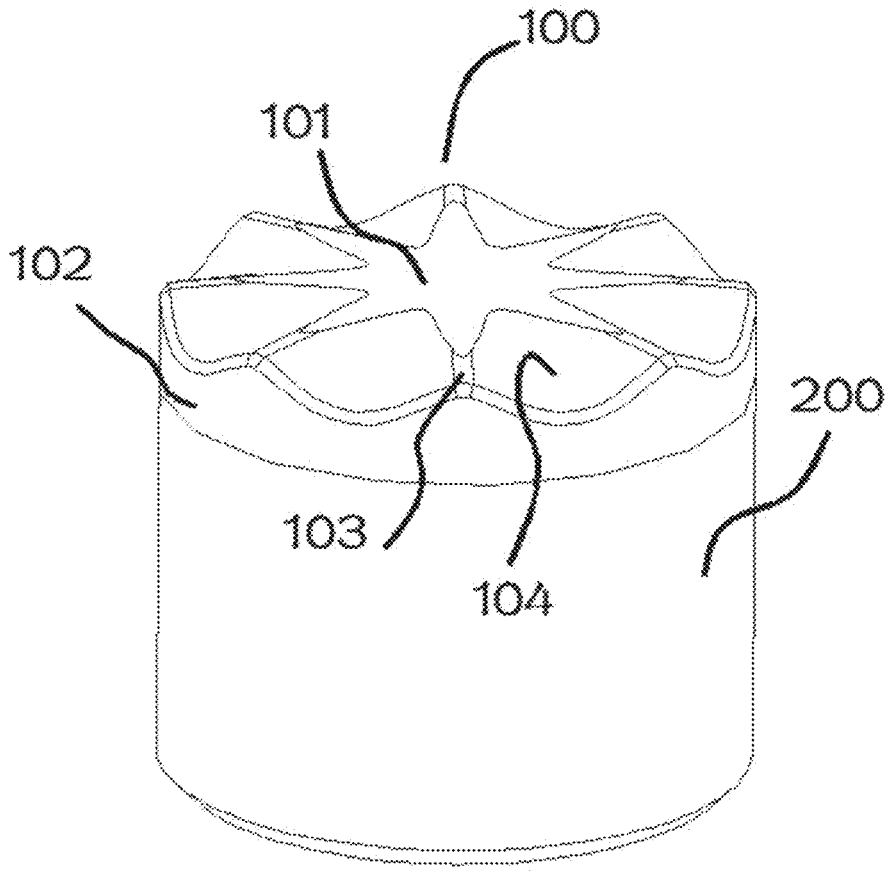
FIG. 7 is a schematic diagram of a polycrystalline diamond compact comprising eight cutting edges of the disclosure.
Figure 8:
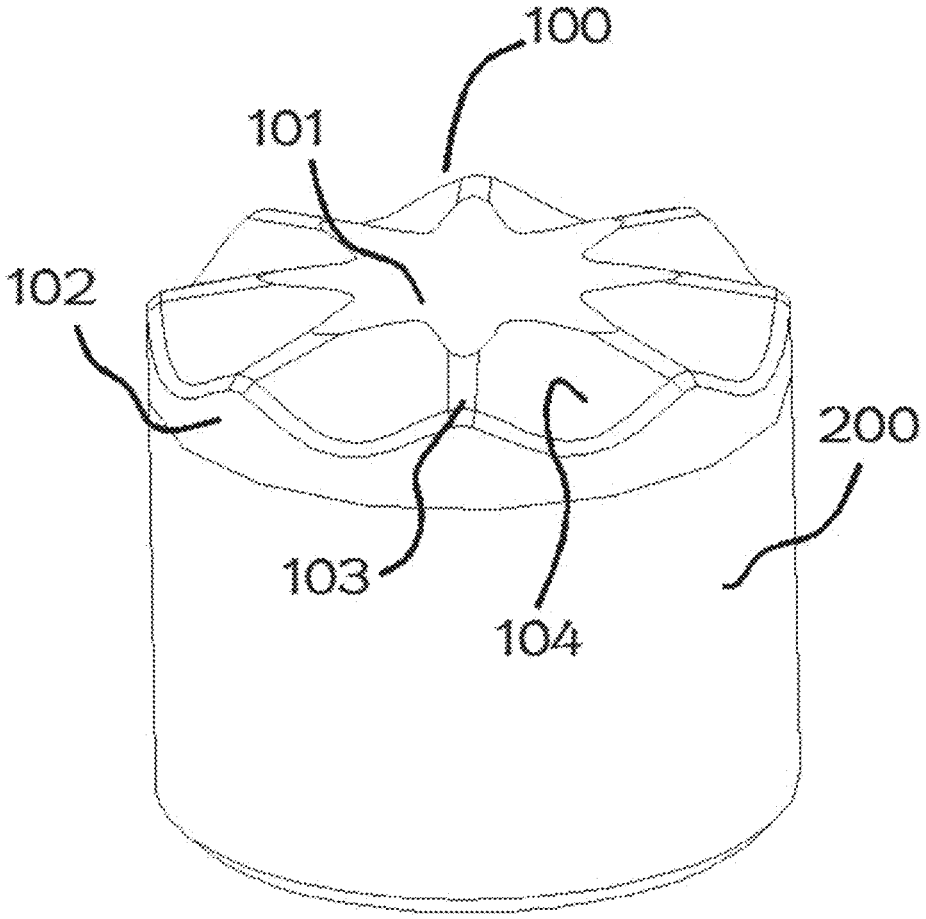
FIG. 8 is a schematic diagram of another polycrystalline diamond compact comprising eight cutting edges of the disclosure.

As shown in FIGS. 7 and 8, a polycrystalline diamond compact comprising eight cutting edges is provided. As shown in FIG. 7, the radial extension length of the cutting edges 103 of the polycrystalline diamond compact is 1.78 mm, and the vertical distance from the peak of each of the cutting edges to the lowest point of the cutting edges is 1.23 mm. The included angle between the cutting edges and the side wall 102 is 90°. The cutting removal grooves 104 and the cutting edges 103 are alternately disposed and form an annular structure on the upper surface with an included angle of 23° between the cutting removal grooves 104 and the cutting edges 103. The included angle between the cutting removal grooves 104 and the side wall 102 is 113°. The vertical height of the chamfer between the cutting edges 103, the cutting removal grooves 104 and the side wall 102 is 0.40 mm.

As shown in FIG. 8, the radial extension length of the cutting edges 103 of the polycrystalline diamond compact is 1.76 mm, and the vertical distance from the peak of each of the cutting edges to the lowest point of the cutting edges is 1.23 mm. The included angle between the cutting edges and the side wall 102 is 99.3°. The cutting removal grooves 104 and the cutting edges 103 are alternately disposed and form an annular structure on the upper surface with an included angle of 32.8° between the cutting removal grooves 104 and the cutting edges 103. The included angle between the cutting removal grooves 104 and the side wall 102 is 122.8°. The vertical height of the chamfer between the cutting edges 103, the cutting removal grooves 104 and the side wall 102 is 0.40 mm.

Example 5

Figure 9:
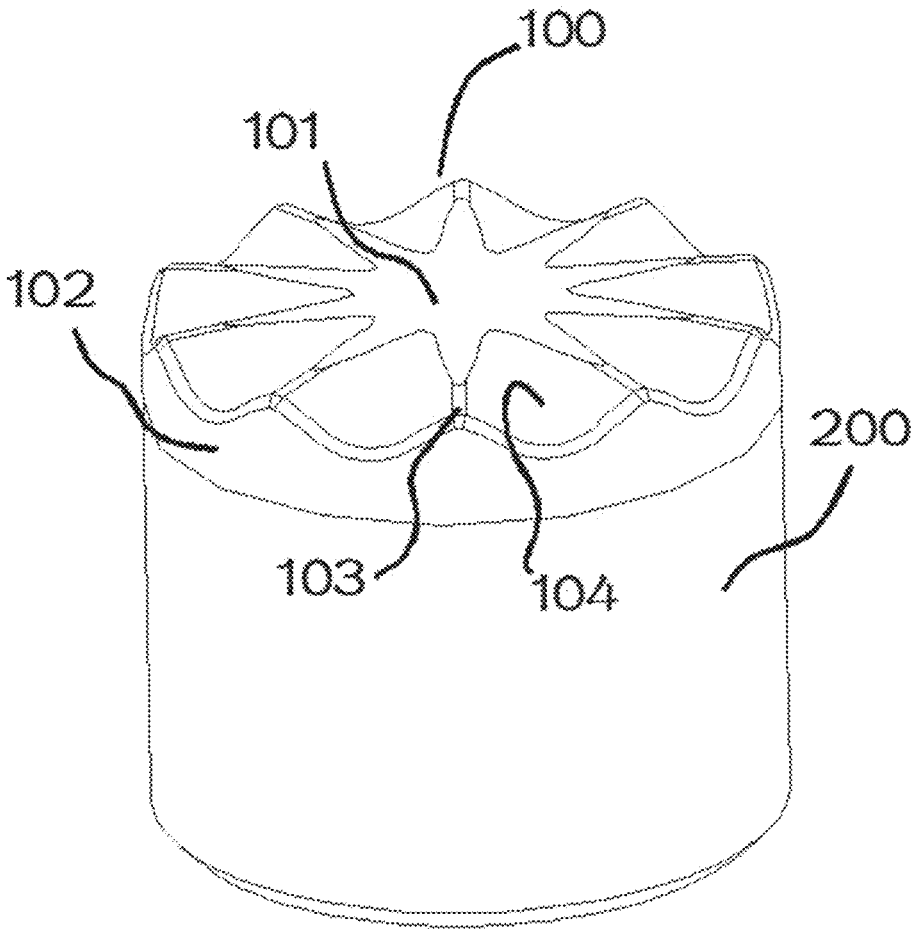
FIG. 9 is a schematic diagram of a polycrystalline diamond compact comprising ten cutting edges of the disclosure.
Figure 10:
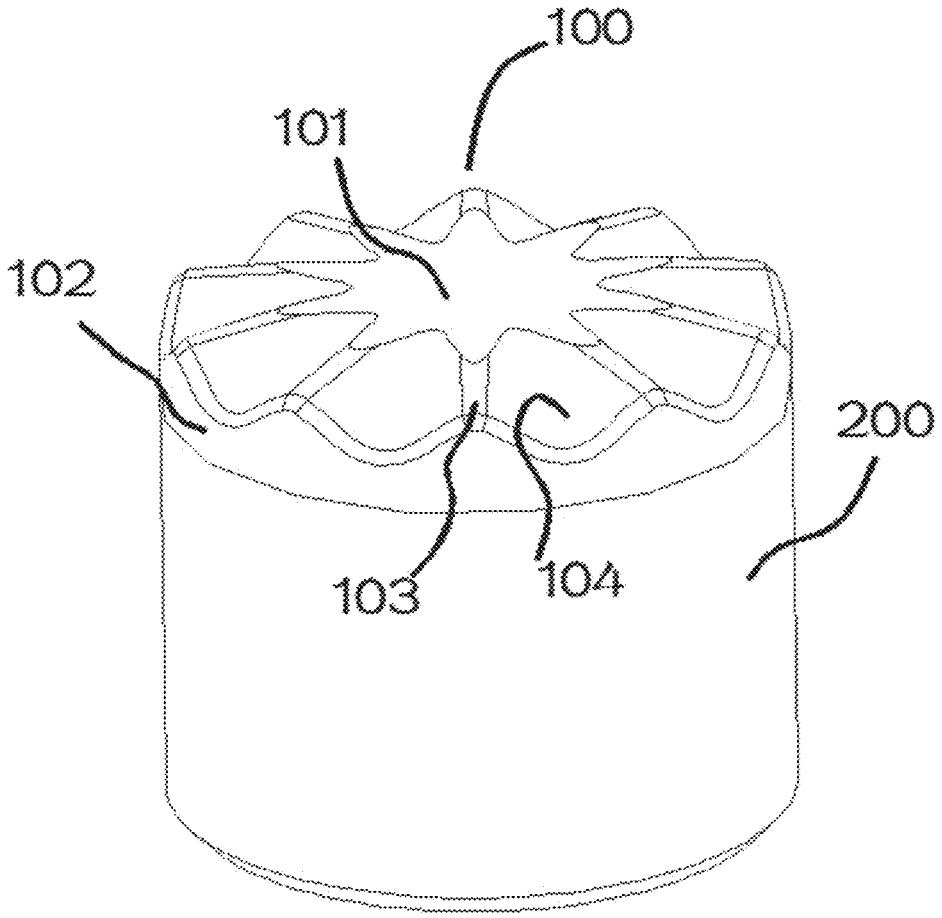
FIG. 10 is a schematic diagram of another polycrystalline diamond compact comprising ten cutting edges of the disclosure.

As shown in FIGS. 9 and 10, a polycrystalline diamond compact comprising ten cutting edges is provided. As shown in FIG. 9, the radial extension length of the cutting edges 103 of the polycrystalline diamond compact is 1.69 mm, and the vertical distance from the peak of each of the cutting edges to the lowest point of the cutting edges is 1.23 mm. The included angle between the cutting edges and the side wall 102 is 90°. The cutting removal grooves 104 and the cutting edges 103 are alternately disposed and form an annular structure on the upper surface with an included angle of 25° between the cutting removal grooves 104 and the cutting edges 103. The included angle between the cutting removal grooves 104 and the side wall 102 is 115°. The vertical height of the chamfer between the cutting edges 103, the cutting removal grooves 104 and the side wall 102 is 0.40 mm.

As shown in FIG. 10, the radial extension length of the cutting edges 103 of the polycrystalline diamond compact is 1.68 mm, and the vertical distance from the peak of each of the cutting edges to the lowest point of the cutting edges is 1.23 mm. The included angle between the cutting edges and the side wall 102 is 99.1°. The cutting removal grooves 104 and the cutting edges 103 are alternately disposed and form an annular structure on the upper surface with an included angle of 36.5° between the cutting removal grooves 104 and the cutting edges 103. The included angle between the cutting removal grooves 104 and the side wall 102 is 126.5°. The vertical height of the chamfer between the cutting edges 103, the cutting removal grooves 104 and the side wall 102 is 0.40 mm.

Example 6

Figure 11:
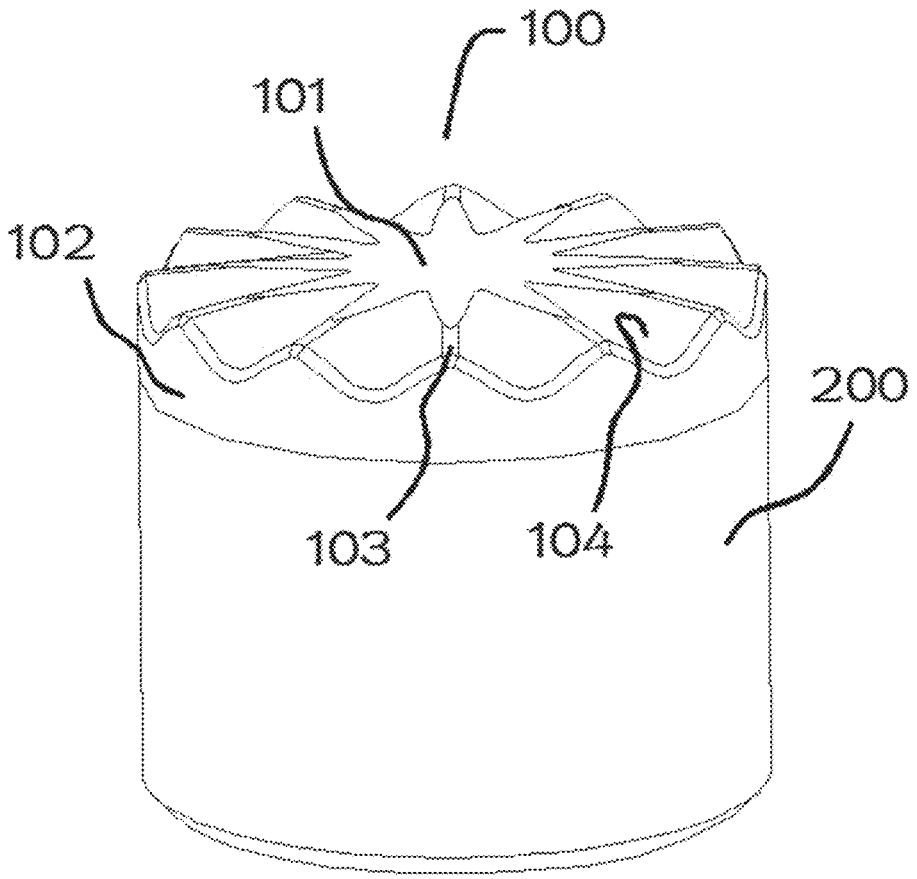
FIG. 11 is a schematic diagram of a polycrystalline diamond compact comprising twelve cutting edges of the disclosure.
Figure 12:
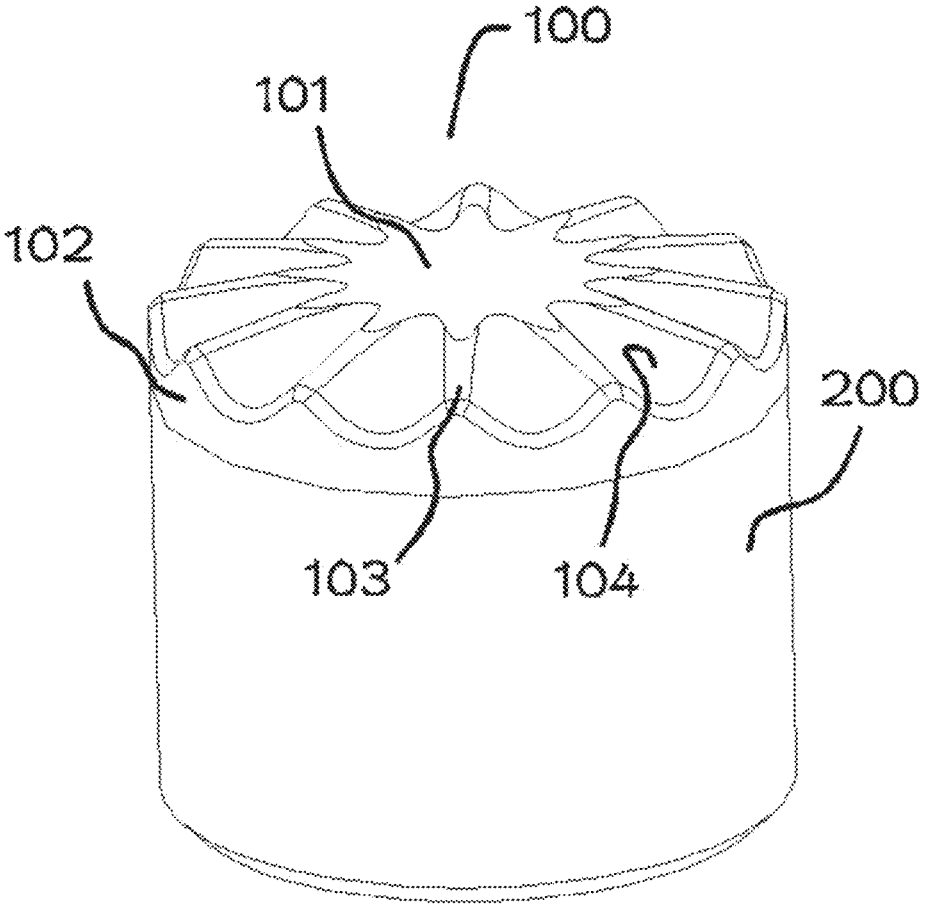
FIG. 12 is a schematic diagram of another polycrystalline diamond compact comprising twelve cutting edges of the disclosure.

As shown in FIGS. 11 and 12, a polycrystalline diamond compact comprising eight cutting edges is provided. As shown in FIG. 11, the radial extension length of the cutting edges 103 of the polycrystalline diamond compact is 1.72 mm, and the vertical distance from the peak of each of the cutting edges to the lowest point of the cutting edges is 1.23 mm. The included angle between the cutting edges and the side wall 102 is 90°. The cutting removal grooves 104 and the cutting edges 103 are alternately disposed and form an annular structure on the upper surface with an included angle of 26° between the cutting removal grooves 104 and the cutting edges 103. The included angle between the cutting removal grooves 104 and the side wall 102 is 116°. The vertical height of the chamfer between the cutting edges 103, the cutting removal grooves 104 and the side wall 102 is 0.40 mm.

As shown in FIG. 12, the radial extension length of the cutting edges 103 of the polycrystalline diamond compact is 1.70 mm, and the vertical distance from the peak of each of the cutting edges to the lowest point of the cutting edges is 1.23 mm. The included angle between the cutting edges and the side wall 102 is 99.7°. The cutting removal grooves 104 and the cutting edges 103 are alternately disposed and form an annular structure on the upper surface with an included angle of 38.3° between the cutting removal grooves 104 and the cutting edges 103. The included angle between the cutting removal grooves 104 and the side wall 102 is 128.3°. The vertical height of the chamfer between the cutting edges 103, the cutting removal grooves 104 and the side wall 102 is 0.40 mm.

The polycrystalline diamond compacts in the examples 1-6 are suitable for drilling in complex formations such as hard rocks and tough interlayers. The multiple cutting edges can greatly improve the utilization rate of the polycrystalline diamond compact, reduce the drilling cost, and prevent the formation of bit balling.

Unless otherwise indicated, the numerical ranges involved include the beginning and end values. It will be obvious to those skilled in the art that changes and modifications may be made, and therefore, the aim in the appended claims is to cover all such changes and modifications.

What is claimed is:

1. A polycrystalline diamond compact, comprising:

a polycrystalline diamond layer, the polycrystalline diamond layer being in the form of a cylinder comprising an upper surface, a bottom surface, and a side wall connecting the upper surface and the bottom surface; and a cemented carbide substrate, the cemented carbide substrate being bonded to the bottom surface of the polycrystalline diamond layer;

wherein:

the upper surface comprises a center part and an edge part;

the center part is a single surface;

the edge part comprises a plurality of cutting edges and a plurality of cutting removal grooves, and the plurality of cutting edges and the plurality of cutting removal grooves are radially distributed on the upper surface and surround the center part;

the plurality of cutting edges and the plurality of cutting removal grooves are alternately disposed on the upper surface;

a first end of each of the plurality of cutting edges and a first end of the plurality of cutting removal grooves are in direct connection to a peripheral edge of the single surface, and a second end of the each of the plurality of cutting edges and a second end of the plurality of cutting removal grooves communicate with the side wall;

each of the plurality of cutting edges comprises a first sloped surface and a second sloped surface forming a ridge having a ridge line extending along a radial direction of the upper surface; and an included angle between the first sloped surface and the second sloped surface is greater than 90°.

2. The polycrystalline diamond compact of claim 1, wherein the plurality of cutting edges and cutting removal grooves forms an annular structure on the upper surface.

3. The polycrystalline diamond compact of claim 1, wherein a vertical distance from a peak of each of the cutting edges to a lowest point of the plurality of cutting edges is greater than or equal to 0.2 mm, and a radial length of each of the cutting edges on the upper surface is greater than or equal to 0.5 mm.

4. The polycrystalline diamond compact of claim 1, wherein chamfers are disposed at a joint between a circumferential edge of the upper surface and the side wall.

5. The polycrystalline diamond compact of claim 1, wherein the center part of the upper surface of the polycrystalline diamond layer is a cutting reservoir.

6. The polycrystalline diamond compact of claim 5, wherein the first end of each of the plurality of cutting edges and the plurality of cutting removal grooves extends to communicate with the cutting reservoir.

7. The polycrystalline diamond compact of claim 1, wherein an included angle between the each of the plurality of cutting edges and the side wall is greater than 90°, where the included angle between the each of the plurality of cutting edges and the side wall is an angle formed between a first straight line and a second straight line; the first straight line is in a plane of symmetry of the each of the plurality of cutting edges and passes through a center point of the center part and a point where the second end of the each of the plurality of cutting edges intersects with the plane of symmetry of the each of the plurality of cutting edges, and the second straight line is parallel to the side wall and intersects with the first straight line.

8. The polycrystalline diamond compact of claim 7, wherein an included angle between the each of the plurality of cutting removal grooves and the side wall is greater than 90°, where the included angle between the each of the plurality of cutting removal grooves and the side wall is an angle formed between a third straight line and a fourth straight line, where the third straight line is in a plane of symmetry of the each of the plurality of cutting removal grooves and passes through the center point of the center part and a point where the second end of the each of the plurality of cutting removal grooves intersects with the plane of symmetry of the each of the plurality of cutting removal grooves, and the fourth straight line is parallel to the side wall and intersects with the third straight line.

9. A polycrystalline diamond compact, comprising:

a polycrystalline diamond layer, the polycrystalline diamond layer being in the form of a cylinder comprising an upper surface, a bottom surface, and a side wall connecting the upper surface and the bottom surface; and a cemented carbide substrate, the cemented carbide substrate being bonded to the bottom surface of the polycrystalline diamond layer;

wherein:

the upper surface comprises a center part and an edge part;

the edge part comprises a plurality of cutting edges and a plurality of cutting removal grooves, and the plurality of cutting edges and the plurality of cutting removal grooves are radially distributed on the upper surface and surround the center part;

the plurality of cutting edges and the plurality of cutting removal grooves are alternately disposed on the upper surface;

a first end of each of the plurality of cutting edges and a first end of the plurality of cutting removal grooves are in direct connection to a peripheral edge of the center part, and a second end of the each of the plurality of cutting edges and a second end of the plurality of cutting removal grooves communicate with the side wall;

the center part is concave toward the bottom surface of the polycrystalline diamond layer;

each of the plurality of cutting edges comprises a first sloped surface and a second sloped surface forming a ridge having a ridge line extending along a radial direction of the upper surface; and an included angle between the first sloped surface and the second sloped surface is greater than 90°.

10. The polycrystalline diamond compact of claim 9, wherein the plurality of cutting edges and cutting removal grooves forms an annular structure on the upper surface.

11. The polycrystalline diamond compact of claim 9, wherein a vertical distance from a peak of each of the cutting edges to a lowest point of the plurality of cutting edges is greater than or equal to 0.2 mm, and a radial length of each of the cutting edges on the upper surface is greater than or equal to 0.5 mm.

12. The polycrystalline diamond compact of claim 9, wherein a protrusion is disposed in a center of the upper surface.

13. A polycrystalline diamond compact, comprising:

a polycrystalline diamond layer, the polycrystalline diamond layer being in the form of a cylinder comprising an upper surface, a bottom surface, and a side wall connecting the upper surface and the bottom surface; and a cemented carbide substrate, the cemented carbide substrate being bonded to the bottom surface of the polycrystalline diamond layer;

wherein:

the upper surface comprises a center part and an edge part;

the center part is a single surface;

the edge part comprises a plurality of cutting edges and a plurality of cutting removal grooves, and the plurality of cutting edges and the plurality of cutting removal grooves are radially distributed on the upper surface and surround the center part;

the plurality of cutting edges and the plurality of cutting removal grooves are alternately disposed on the upper surface;

a first end of each of the plurality of cutting edges and a first end of the plurality of cutting removal grooves are in direct connection to a peripheral edge of the single surface, and a second end of the each of the plurality of cutting edges and a second end of the plurality of cutting removal grooves communicate with the side wall;

an included angle between the each of the plurality of cutting edges and the side wall is greater than 90°, where the included angle between the each of the plurality of cutting edges and the side wall is an angle formed between a first straight line and a second straight line; the first straight line is in a plane of symmetry of the each of the plurality of cutting edges and passes through a center point of the center part and a point where the second end of the each of the plurality of cutting edges intersects with the plane of symmetry of the each of the plurality of cutting edges, and the second straight line is parallel to the side wall and intersects with the first straight line; and an included angle between the each of the plurality of cutting removal grooves and the side wall is greater than 90°, where the included angle between the each of the plurality of cutting removal grooves and the side wall is an angle formed between a third straight line and a fourth straight line, where the third straight line is in a plane of symmetry of the each of the plurality of cutting removal grooves and passes through the center point of the center part and a point where the second end of the each of the plurality of cutting removal grooves intersects with the plane of symmetry of the each of the plurality of cutting removal grooves, and the fourth straight line is parallel to the side wall and intersects with the third straight line.

14. The polycrystalline diamond compact of claim 13, wherein the plurality of cutting edges and cutting removal grooves forms an annular structure on the upper surface.

15. The polycrystalline diamond compact of claim 13, wherein a vertical distance from a peak of each of the cutting edges to a lowest point of the plurality of cutting edges is greater than or equal to 0.2 mm, and a radial length of each of the cutting edges on the upper surface is greater than or equal to 0.5 mm.

16. The polycrystalline diamond compact of claim 13, wherein chamfers are disposed at a joint between a circumferential edge of the upper surface and the side wall.

* * * * *